United States Patent [19]

Westphal

[11] Patent Number: 4,899,167

[45] Date of Patent: Feb. 6, 1990

[54] COLLAPSIBLE ANTENNA

[75] Inventor: Manfred Westphal, Bermatingen, Fed. Rep. of Germany

[73] Assignee: Dornier System GmbH, Friedrichshafen, Fed. Rep. of Germany

[21] Appl. No.: 67,728

[22] Filed: Jun. 26, 1987

[30] Foreign Application Priority Data

Jun. 27, 1986 [DE] Fed. Rep. of Germany ..... 3621578

[51] Int. Cl.[4] ..... H01Q 15/20

[52] U.S. Cl. ..... 343/915; 343/912; 343/916

[58] Field of Search ..... 343/915, 912, 916

[56] References Cited

U.S. PATENT DOCUMENTS

| | | | |
|---|---|---|---|
| 3,064,534 | 11/1962 | Tumavicus | 343/915 |
| 3,541,569 | 11/1970 | Berks et al. | 343/915 |
| 3,699,576 | 10/1972 | Hoyer | 343/915 |
| 3,715,760 | 2/1973 | Palmer | 343/915 |
| 4,511,901 | 4/1985 | Westphal | 343/915 |

*Primary Examiner*—Joseph E. Clawson, Jr.
*Assistant Examiner*—Hoanganh Le
*Attorney, Agent, or Firm*—Ralf H. Siegemund

[57] ABSTRACT

A foldable and deployable antenna reflector includes a central panel having along its circular periphery a circular-sawtooth shaped contour with ramplike edges separated by radial cut backs and a plurality of similar, rigid segments, each having a foot edge are respectively hinged by means of a single hinge axis to the ramplike sawtooth edges.

3 Claims, 7 Drawing Sheets

COLLAPSIBLE ANTENNA

BACKGROUND OF THE INVENTION

The present invention relates to a foldable and collapsible, concavely curved antenna reflector having, when deployed, a very highly accurate contour in terms of geometric contour and feature requirements, and being made of uniform rigid segments hingedly connected to a central panel.

Antenna reflectors are, for example, constructed from carbon fibre re-enforced, synthetic material (CFK); this kind of material is used particularly to construct rigid antenna reflectors. Such a material permits satisfying the requirements for space technology and involving contour accuracy and, therefore, high performance antenna systems. Power and performance of such antenna are, however, limited owing to the size, dimensions, etc. of the payload space in a carrier space vehicle. Completely rigid antennas are highly impractical in space hence the requirements for practical purposes can be satisfied only when the antenna is of a collapsible and foldable construction, i.e. can be launched compactly folded to be unfolded and deployed after launching. Particularly, such antennas are folded down and moved by the carrier vehicle into an orbit, for example, and, once in orbit the antenna is deployed using an appropriate deployment mechanism.

Basically, antenna reflectors of the collapssible and foldable variety come in two versions, and, in fact, it is believed that only these two alternatives are available for space use. Owing particularly to the requirement of the high contour accuracy. One of the types is a grid or mesh type of reflector which, however, was also found to be unsatisfactory as far as contour accuracy is concerned, so that actually only one type of reflector remains, namely the type to which the invention pertains, including foldable rigid and hinged segments. Reflectors with these foldable rigid segments come in a variety of different configurations, however, some of these configurations are disadvantaged by the requirement for an excessive number of joints and segment pieces which, owing to the particular folding and collapsing construction, are of different shape and size. Also, the larger the number of hinges and segments, the more complex will be the deployment mechanism and its operation. The deployment mechanism must, in addition, be constructed to orient the various panels or segments in relation to each other which, or course, is again a task whose complexity increases with the number of panels involved. Unfortunately, it has not been possible to reinforce the panels and segments through ribs, lattice structure or the like, owing to the lack of storage space in the carrier vehicle. On the other hand, it is clear that the larger such an antenna, the greater is the need for stiffening and re-enforcing elements simply to maintain the desired degree of accuracy.

Antenna reflectors of the type referred to above are generally known, for example, through U.S. Pat. Nos. 3,699,576 and 3,715,760. These patents indeed show central panel and single axes joints and hinges for pivotally mounting these various segments or panels to that central panel. In the first patent, the segments are, to some extent, supported and re-enforced through a small lattice structure in the rear. In both instances, there is an interconnection of the various segments through hinges, which support and permit the folding and unfolding of the various segments. A similar configuration is, for example, shown in the NASA-Conference Publication 2118, of November, 1979, and described by J. S. Archer under "Advanced Sunflower Antenna Concept Development". Aside from the relatively large construction and expenditure needed here, there is an added weight problem, but the primary disadvantage of the structure is the large number of hinges which, on one hand, are necessary for finally attaining the desired contour accuracy, but as far as the deployment procedure is concerned, these hinges are troublesome.

German printed patent application No. 31 28 978 shows a foldable radiation reflector of rotational symmetry, having a plurality of segments arranged around the axis of symmetry and being pivotally connected to the requisite support structure. Upon folding down, the segments have a particular position of deployment, and they are now being turned in the same direction and in the same manner, about the respective turning axis being associated with each panel and extending parallel to the aforementioned axis of symmetry, while simultaneously they pivot up. This way the panels are folded down. For purposes of deployment, the aforementioned motions are directly reversed whereby particularly each panel will undergo again a simultaneous turning and pivot motion. This method of deployment as disclosed, is disadvantaged by the fact that deployment and folding down requires a rather complex turning and pivot mechanism whose complexity, to some extent, interferes with the accuracy of the antenna once deployed. Stiffening of the segments in relation to the central and stationary reflector part, is very difficult.

Another proposal has been made in "SCI" (83) 1, pages 7 through 16, and 63 through 66, for the FIRST satellite, involving particularly an antenna construction of the folded variety. The segments are preferably arranged on the central segment, and they are also interconnected to each other through hinges. Folding and deployment of the segments is carried out in a single axis operation, through radial pivoting of the segments without turning. This reduces the complexity of the pivot mechanism, and acutally increases the accuracy of the deployed shape. However, it was found that this particular antenna is highly disadvantaged by an ineffective utilization of the available storage room and poor possibility of additional stiffening. Moreover, owing to the segment position when folded down, the various hinges and segments have different dimensions.

In accordance with U.S. Pat. No. 4,511,901, a foldable antenna reflector is known wherein hinged joints of the outer ends of juxtaposed segments are provided through connecting rods being attached towards the middle of the outer end of a segment. The joint connecting the segments with a central panel is of a two-axis construction similar to German patent application No. 31 28 978. A drive acts on this two-axis hinge for purposes of deployment of the reflector such that the segments will pivot radially outwardly. The accuracy attainable with this reflector is very high, but the position of accuracy is supported by expensive and very complex mechanical means. Moreover, guide rods on the head end of the segments are necessary for synchronizing the in-turning motion and for attaining the requisite contour accuracy.

DESCRIPTION OF THE INVENTION

It is an object of the present invention to provide a new and improved foldable, collapsible, and deployable antenna reflector such that the segments or panels of which it is composed permits deployment from a folded down state through a simpler mechanical mechanism as any of the known mechanisms, whereby for reasons of simplification and as a constraint on expenditure, the segments or panels should be pivotably only about a single turning axis and should be amenable to be folding up synchronously, i.e. in unison, by means of a central drive. Upon deployment, the segments should attain their positions in a stable fashion, and at a requisite degree of accuracy; adjustment should be both permissible and simple; in the folded down state all the panels or segments should be more or less uniformly oriented, whereby between the segments some space should be left for any additional or supplemental re-enforcement.

In accordance with the preferred embodiment of the present invention, it is suggested to provide a central panel with a sawtooth contour along its periphery wherein the "teeth" correspond in number and width to the number and width of segments to be connected by single axis hinge connectons are arranged on the various "teeth" particularly with parallel running axes for the connection to the segments. In furtherance of the invention, the segments, when folded, should be provided with uniformly oriented contour curvatures and with an inclination towards the central panel, and orientation from the periphery to the axes. There is known per se a central drive which sould be provided to all of the panels, simultaneity is insured by causing deployment through rods and hinges, and linkage acting on the outer surface of the segments. Following deployment, the segments are latched to the rods. Individual segments should be individually adjustable.

The invention offers the advantage that the circular saw configuration of the central panel and the lack of coupling of the segments to each other, reduces the overall mechanism for the deployment. Moreover, turning and pivoting of the segments is limited to a single turning motion which, of course, could also be called a pivot motion. Simplification of the folding mechanism is actually directly instrumental in attaining the requisite high degree of geometric accuracy for the contour whenever the panels or segments are deployed. Moreover, there is adequate space available to obtain and to provide for additional sufficient stiffening of the segments; as the panels are all folded down, the packing density is quite high.

Since the segments are decoupled from each other, they are adjustable individually towards attaining the requisite contour accuracy. The reduction in requisite components is not only an economic saving, and not only a simplification in the deployment mechanism, but also a significant saving in weight. The saw-tooth shaped central panel is provided with obliquely, rearwardly oriented sections, and each of them is provided with two single axis hinges. The axes are almost parallel to the edges of these sections, and the various panels and segments are folded around these axes, by operation of these hinges. The number of sections and segments depends, of course, on the size of the antenna reflector, modified possibly by the storage facilities actually available for the antenna and the space vehicle. The direction of the segments and the hinges with pivot axis are oriented in dependence upon the position the segments have when folded down. The foot edges of the segments are bevelled corresponding the direction of the axes. This feature permits arranging the bearing points of the single axis hinges at a sufficiently for spacing and that feature, in turn, increases the stiffness as well as the positional accuracy, particularly tangential to the central axis as far as the antenna reflector is concerned. The hinges can be made of a small configuration, and in spite of the high packing density the segments may be, as stated, provided with ribs or lattice structure for stiffening. These reenforcing elements being in the rear of the respective segments.

Large segments or panels may be subdivided into subpanels being interconnected through a lattice structure. In this case, the control of the deployment through a central drive and the pivot motion of the subpanels or segments is combined through rods and additional hinges, such as knee joints under further utilization of reducing gears. The various subsegments will be independently adjustable through individually controllable adjusting members, for fixing and locking the parts in the folded state; one uses here stops and latches known per se. Alternatively, the folding or rod linkage could be locked by centralizing the lock and latching mechanism.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIGS. 2*a*, 2*a'*, 2*b*, 2*b'*, 2*c*, 2*c'* and 2*d* respectively, 2*a'* through 2*d'*, show in pairs perspective views and top elevation of the antenna reflector shown in FIGS. 1 and 1*a*, in different stages of deployment with FIG. 2*a* corresponding to FIG. 1*a.

FIGS. 5 and 5*a* are a similar pair of views compared with FIGS. 3, 3*c* and 4, 4*c* showing a central panel with lattice reinforced central panel and segmentized segments;

Proceeding now to the detailed description of the drawings, FIGS. 1 and 1*a* illustrate a satellite configuration for an antenna reflector 1 mounted to the top side of a space vehicle, under utilization of a tower structure 1a. FIG. 1a illustrates the collapsed and folded down state of the antenna reflector, and FIG. 1 illustrates the deployed state. The state shown in FIG. 1a is assumed to present the reflector in a state and condition permitting storage in a space vehicle, particularly in a carrier rocket, or the like.

Figure 1:
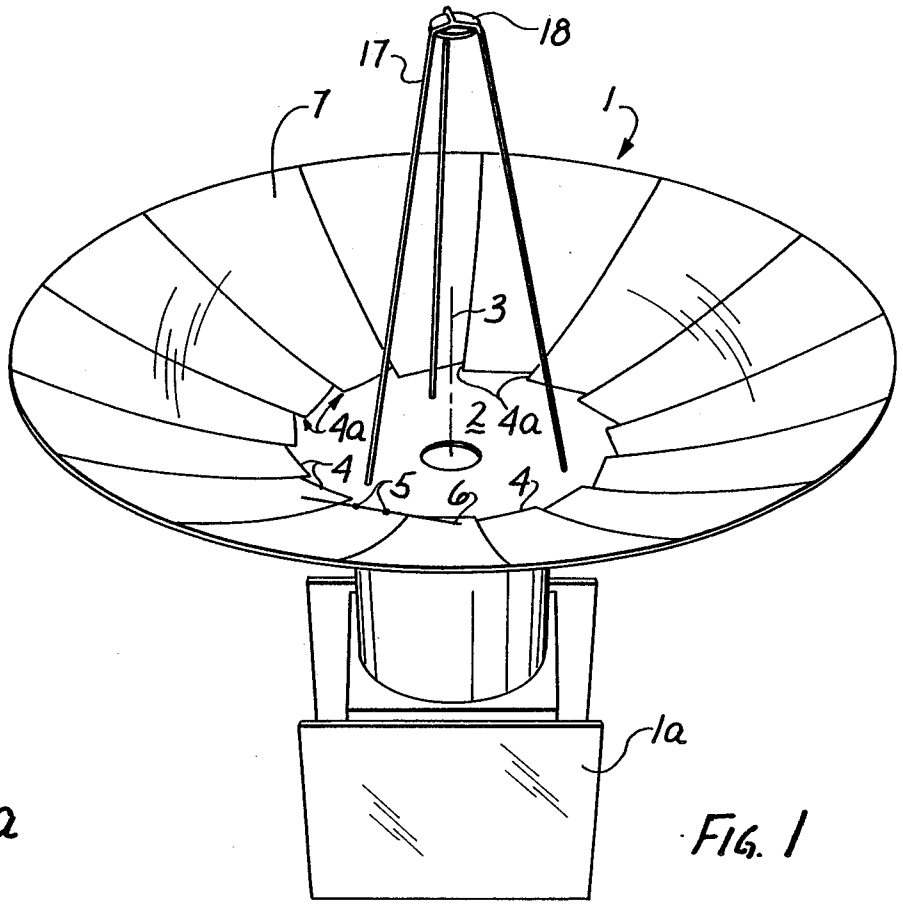
FIG. 1 is a perspective view of a reflector with supplemental reflector tower in the deployed state, and constructed in accordance with the preferred embodiment of the present invention for practicing the best mode thereof.
Figure 1A:
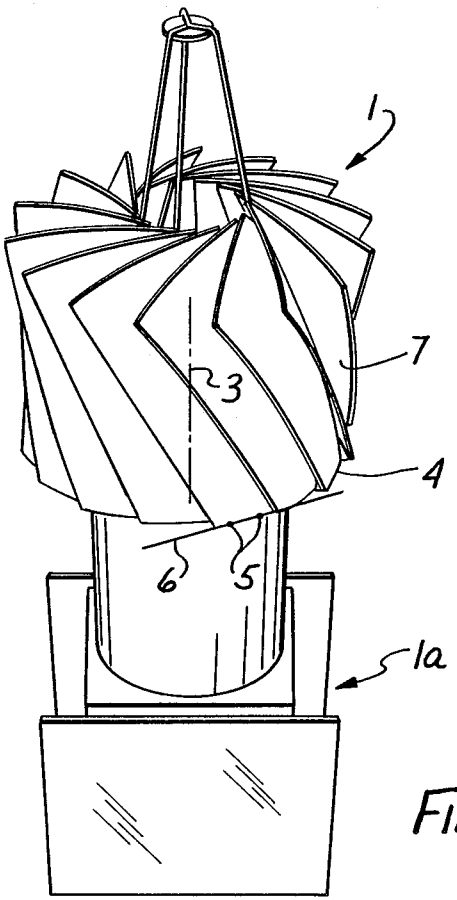
FIG. 1a shows the same reflector shown in FIG. 1 but in a folded down dispostion.

Following launch and following removal from the interior of the carrier vehicle, the reflector 1 is deployed i.e. its state and condition is changed from the one shown in FIG. 1a to FIG. 1. The panels or segments 7 have the appropriate and desired position of deployment in FIG. 1, and will be latched in that position. The structure includes a central panel 2 with a circular sawtooth contour along its periphery. This is particularly visible in FIG. 1 showing the ramplike "tooth" portions 4 separated by cut backs 4a. The reflector 1 carries, in addition, a sub-reflector 18 mounted on the central panel 2 by means of a three-leg tower 17. In addition, this tower serves as a kind of limiting and position defining structure for the panels 7 during the folded up and launch phase, for example, as shown in FIG. 1a.

The sawtooth edges 4 of the reflector 1 runs obliquely to the axis 3 of the reflector do not intersect that axis. The sections 4 pertaining particularly to the central panel 2, each is provided with two single axis hinges 5 serving for establishing the respective single axis hinge axis, such as 6. The individual segments or panels 7 will be pivoted during deployment as well as folding down with each segment being tilted or pivoted about one axis, namely the respective axis 6. The pivot axis 6 run parallel or near parallel to the various sections 4 of the central panel 7, which is the same thing as saying that they run parallel or nearly parallel to the foot edge of the respective panels or segments 7.

In the initial, as well as transport phase (FIG. 1a) the segments 7 do not extend at right angles to the central panel 2, but are more or less inclined, which depends on the relative geometry of panels and of the central panel 2. The panels or segments 7 are nevertheless disposed within a hypothetical cylinder corresponding to the largest diameter of the central panel 2, and they are arranged so that their contour curvatures are all oriented in the same direction as can be seen from the perspective view of FIG. 1a.

Figure 2G:
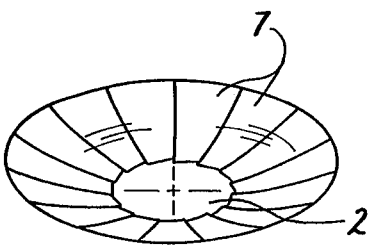
Figure 2H:
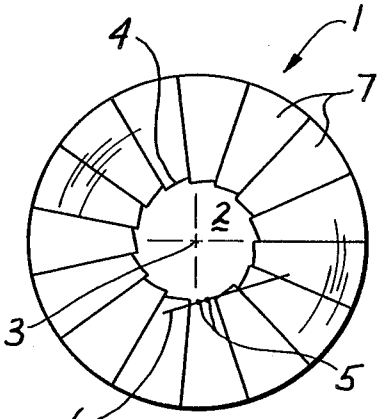
Figure 2E:
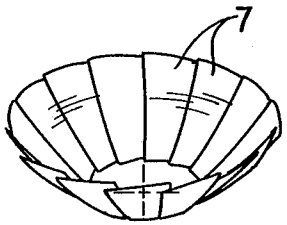
Figure 2F:
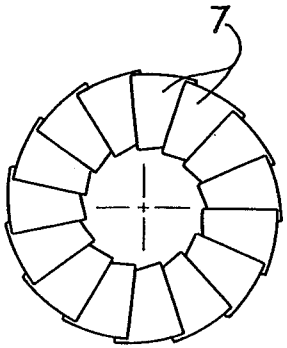
Figure 2C:
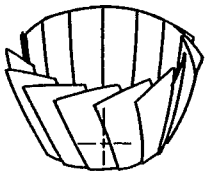
Figure 2D:
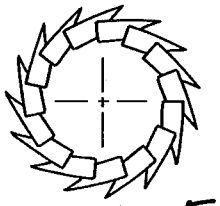
* FIG. 2*d* corresponding in that regard to FIG. 1*a*, 2*d'* being the corresponding top elevation.
Figure 2A:
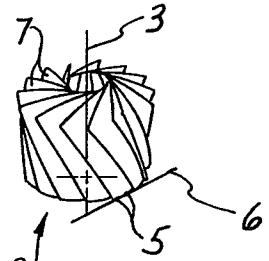
Figure 2B:
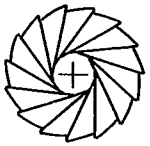

FIG. 2a, 2a'; 2b, 2b'; etc. to 2d', show the various opening and deployment phases of an antenna reflector 1. The status from the folded down disposition of FIGS. 2a and 2a', corresponding to FIG. 1a, and the changeover occurs up until the fully deployed state as shown in FIGS. 2d and 2d'. The figs. are self-explanatory and show unfolding and mutual displacement of the panels in relation to each other.

Figure 3:
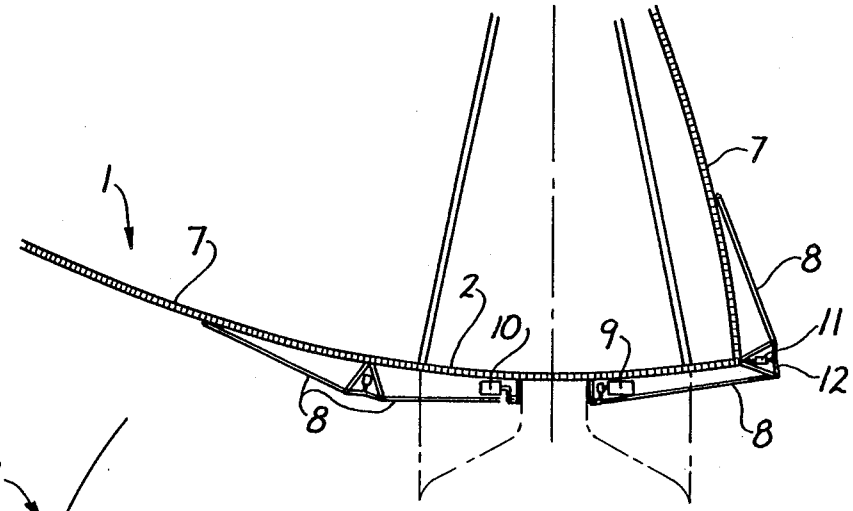
FIGS. 3 and 3*a* are respectively side elevation and bottom elevation of the antenna reflector with self-supporting segments, shown in a folded up (right), and in a deployed state (left)
Figure 3A:
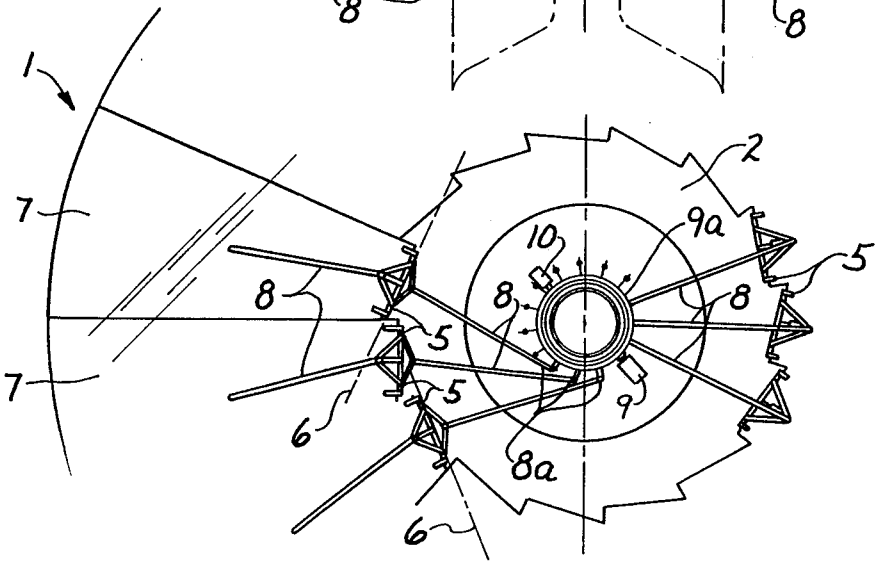

FIGS. 3 and 3a illustrate a section or portion of an antenna reflector 1, in the opened or deployed state (left of the dash dot line), laterally, as well as in the folded up state (right of dash dot line). The segments or panels 7 are self-supporting and are disposed with their respective under-surfaces on fold rods 8. Deployment of the segments or panels 7 results from operation of a central drive 9 arranged under the central panel 2, operating the rod and fold linkage 8. The drive 9 turns a ring 9a, as seen from the bottom in FIG. 3a, counterclockwise to obtain the deployed state. As ring 9a turns the rods 8 hinge at points 8a and pull the panels 7 down. As soon as the end position is attained, segments 7, as well as rods 8, are locked in this position through a locking or latching mechanism 10, which is likewise disposed on the underside of central panel 2. Latch 10 is adjustable towards attaining the desired overall contour of the panels and segments as positioned. Moreover, adjustable members 11 are provided respectively on the underside of each of the panels or segments 7 to proivde fine position tuning. A knee lever 12 acted upon by adjusting device 11, is provided with a favorable transmission ratio to, indeed, permit fine tuning and adjustment. The adjustment may be preparatory on ground but a trimming and tuning adjustment may be advisable to be carried out in orbit. Hinges 5 are shown particularly in the lower FIG. 3a showing also pivot axes 6 in their mutual arrangement of juxtaposed panels and segments. In order to take up the torque as it rises during folding by operation of the rods 8, one needs a reduction gear as part of the drive 9 or such gear is added thereto (not shown).

Figure 4:
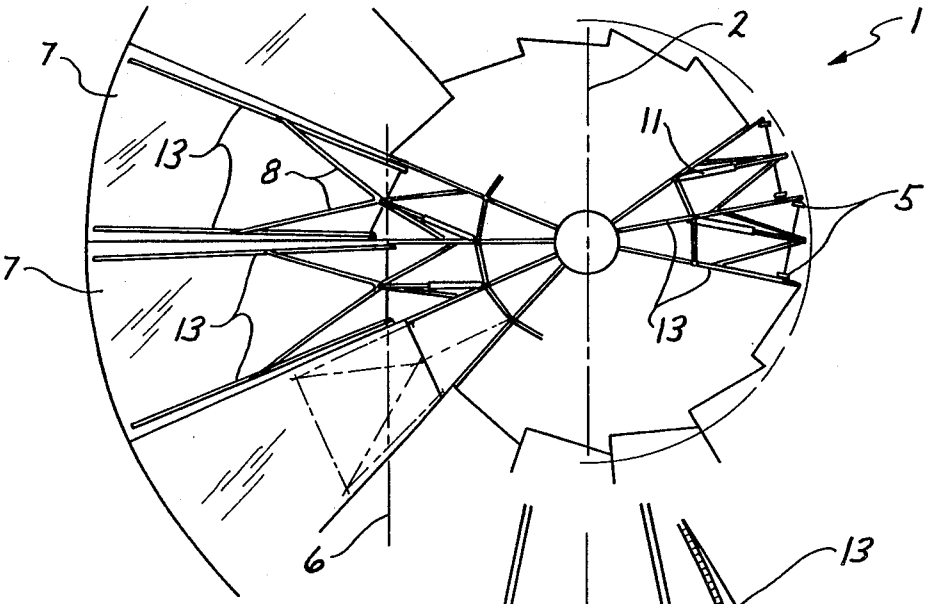
FIGS. 4 and 4*a* are a similar pair of views as compared with FIGS. 3 and 3*a*, showing, however, a central panel and segments with re-enforcing ribs.
Figure 4A:
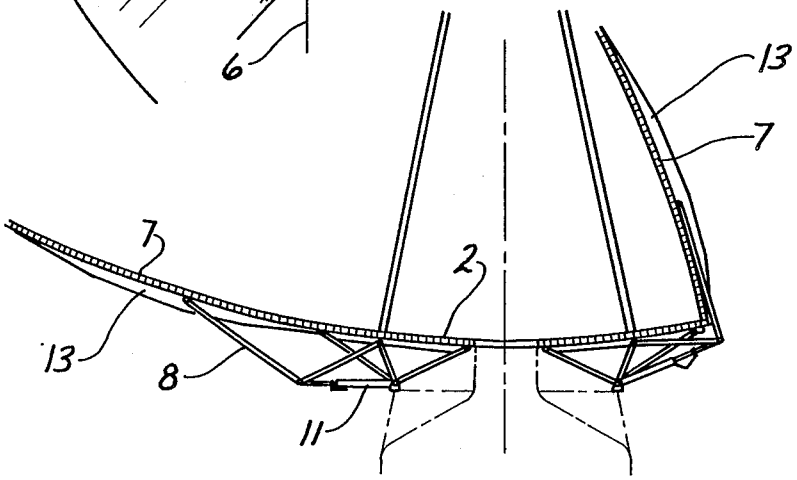

FIGS. 4 and 4a are respectively basically similar to FIGS. 3 and 3a, as far as the antenna reflector is concerned. The dash dot line again separates deployed (left) from folded up (right) situations. The panels 2 and segments 7 are re-enforced by ribs which themselves are pivoted around axis 6 upon deployment. In other words the load bearing aspect is established by the ribs or rib frame of the reinforcement so that the drive 9, 9a with rod linkage 8 acts on the rib frame. The adjusting member 11 is acting on the underside of each of the panels or segments 7, and these members are operatively connected through the rods 8 with the ribs 13 and, therefore, permit the segment/panels 7 to be moved independently from each other and individually.

Figure 5A:
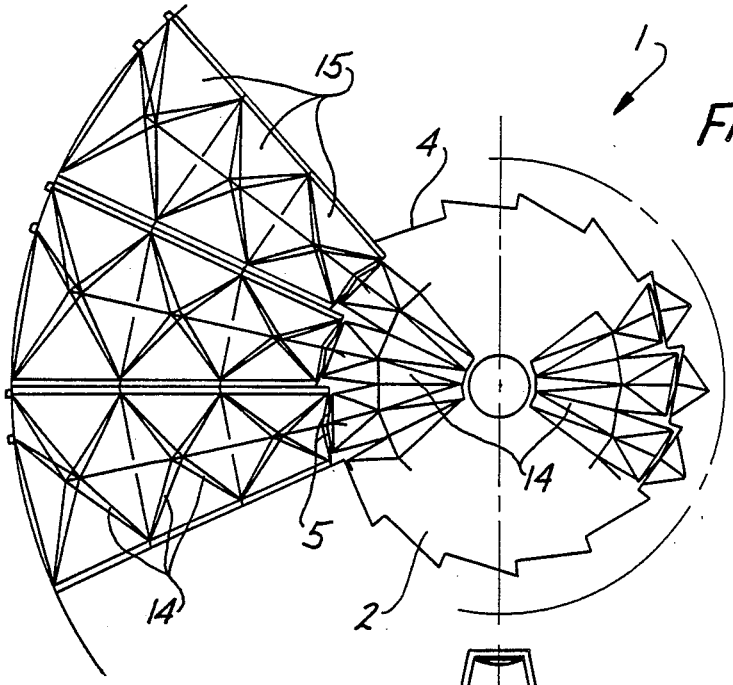
Figure 5B:
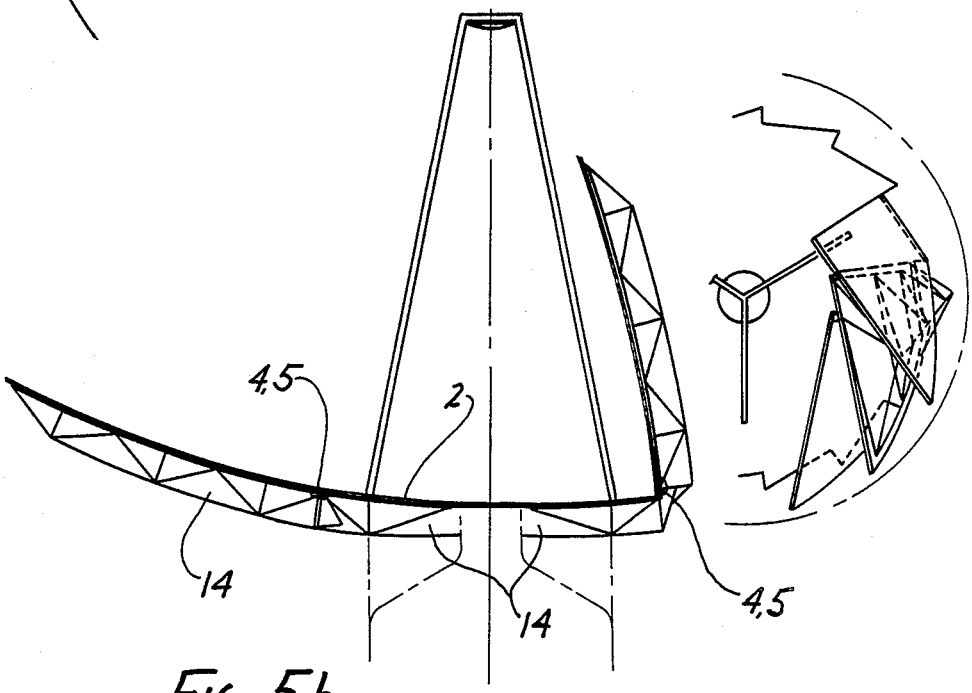
FIG. 5*b* is a top elevation of the right hand portions of FIGS. 5 and 5*a;*

FIGS. 5, 5a and 5b show the antenna reflector similar to FIGS. 3, 3a and 4, 4a with a lattice structure 14 provided for stiffening the central panel 2. The tooth segments or edges 4 are provided here also for hinging (hinges 5) but now for the partial or subs segments or panels 15, of which the individual segments 7 are composed. Partial or sub segments 15 are individually stiffened through lattice structure elements 14. Such a construction is particularly advantageous when the antenna reflector is rather high and still rather large and high degree of accuracy of the contour is required.

Figure 6:
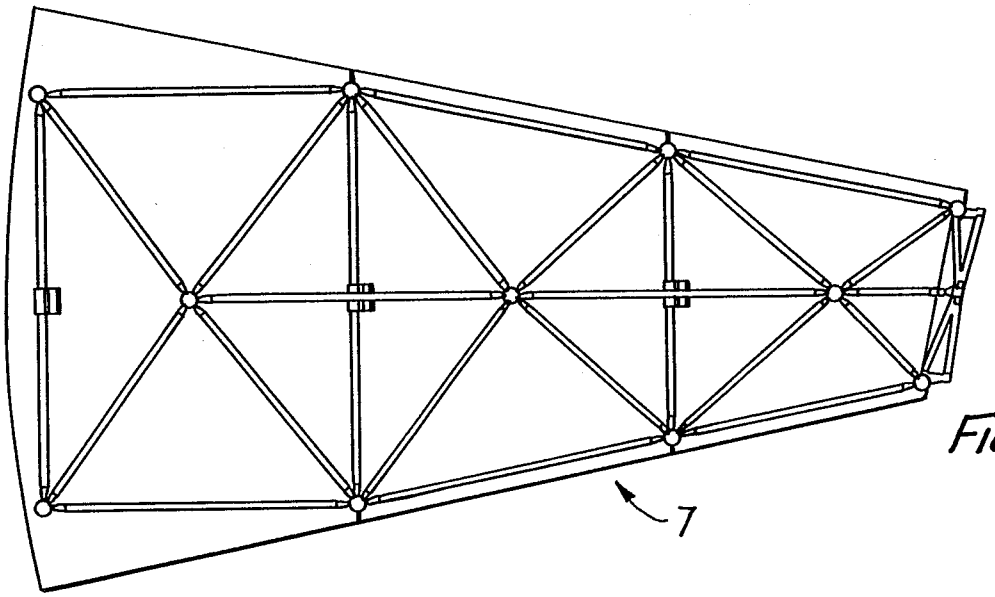
FIGS. 6 and 6*a*, respectively, show bottom and side elevation of a segment assembled from three sub-segments.
Figure 6A:
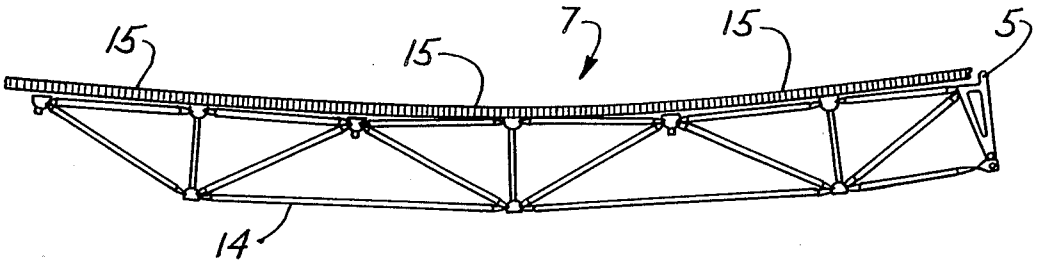

FIG. 6 and 6a illustrate a single segment 7 in a side view (6a) and from below (FIG. 6). Again there is a lattice structure 14 for stiffening the rear of the segment, and thereby the segment as a whole. The segment 7 itself is comprised of three partial segments or subpanels 15 which are independent from each other but with, at least, four points connected to the lattice structure 14. The reason for this arrangement is to take up thermally induced deformations and the individual or sub or segments or sub-panels 15 are, as far as thermal expansion and contraction is concerned, decoupled from each other. This feature is of a great advantage as far as the integrity of the shape and contour of the reflector as a whole is concerned, and involves particularly, of course, the lattice structure 14.

Figure 7A:
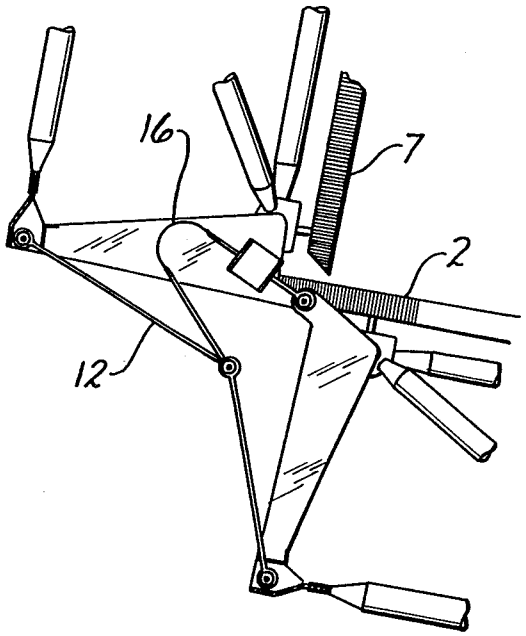
FIGS. 7 in parts a and b are views of a mechanism for the latching lattice structure stiffening segments in various operational states.
Figure 7B:
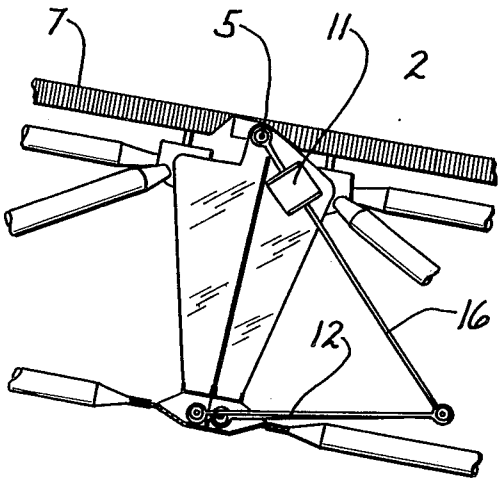

FIG. 7 shows the latching mechanism for locking the deployed and lattice stiffening segments or panels 7 the latching position being shown in the right-hand fig.(b). The latching includes primarily a knee or bend lever 12 which is in an end position upon deployment of the segment of panel 7; lever 12 is held in that position by means of a particularly contour and shaped spring 16. Spring 16 stretches (or is being stretched) on deployment of the segment. An adjustment member 11 is connected to the spring 16 which, whenever it is stretched, acts upon the lever 12 such that at a given favorable transmission ratio the segments 7 can be adjusted with a high degree of accuracy right at the knee lever 12. The left-hand fig. (a) shows the adjusted segment in folded disposition.

The invention is not limited to the embodiments described above but all changes and modifications thereof, not constituting departures from the spirit and scope of the invention, are intended to be included.

I claim:

1. A foldable and deployable antenna reflector comprising:

a central panel being a part of the antenna and participating in reflection, the panel having along its circular periphery a circular-sawtooth shaped contour with ramplike edges separated by radial cut backs; and a plurality of similar, rigid reflector panel segments forming the antenna reflector corresponding in number and width to the number and width of the ramplike sawtooth edges, each segment having a foot edge respectively hinged by means of two, single hinge axis hinges to the ramplike sawtooth edges, the single axis running at least near parallel to these ramplike sawtooth edges.

2. A foldable and deployable antenna reflector as in claim 1, there being a central drive under said central panel and being linked by means of rod linkage to all the segments for concurrent folding and unfolding of all said segments.

3. A foldable and deployable antenna reflector as in claim 2, the central drive including a rotating ring and rods linked to the ring for translating rotating ring motion into a fold up and down motion of the segments.

* * * * *